US007726501B2

(12) United States Patent
Macqueen et al.

(10) Patent No.: US 7,726,501 B2
(45) Date of Patent: Jun. 1, 2010

(54) THREE-DIMENSIONAL FRAME STRUCTURE OR SUPPORT STRUCTURE FOR TRANSPORTING AND/OR STORING AN OBJECT AND METHOD FOR THE PRODUCTION THEREOF

(75) Inventors: Mark Macqueen, Vienna (AT); Roman Harrer, Vienna (AT)

(73) Assignee: Mondi Technology Investments S.A., Luxembourg (LU)

( * ) Notice: Subject to any disclaimer, the term of this patent is extended or adjusted under 35 U.S.C. 154(b) by 162 days.

(21) Appl. No.: 11/802,146

(22) Filed: May 21, 2007

(65) Prior Publication Data

US 2007/0221537 A1 Sep. 27, 2007

Related U.S. Application Data

(63) Continuation of application No. PCT/AT2005/000467, filed on Nov. 18, 2005.

(30) Foreign Application Priority Data

Nov. 19, 2004 (AT) ..... GM846/2004 U

(51) Int. Cl.
*B65D 6/00* (2006.01)
*B65D 8/14* (2006.01)

(52) U.S. Cl. ..... 220/4.28; 220/9.2; 220/668; 206/600

(58) Field of Classification Search ..... 206/521, 206/523, 588, 600; 220/4.28, 9.2, 9.4, 62.11, 220/62.2, 668; 229/199.1; 217/43 A, 43 R; 108/51.3, 56.1
See application file for complete search history.

(56) References Cited

U.S. PATENT DOCUMENTS

| | | | | |
|---|---|---|---|---|
| 2,481,855 | A * | 9/1949 | McKenzie | 206/446 |
| 3,469,542 | A | 9/1969 | Ahlenius | 108/56 |
| 4,756,417 | A | 7/1988 | Teixeira | 206/386 |
| 4,979,446 | A * | 12/1990 | Winebarger | 108/51.3 |
| 4,998,636 | A * | 3/1991 | Hardigg | 220/4.34 |
| 5,218,913 | A * | 6/1993 | Winebarger et al. | 108/51.3 |
| 5,425,314 | A | 6/1995 | MacFarland | 108/51 |
| 5,487,335 | A | 1/1996 | Iijima et al. | 101/181 |
| 6,564,724 | B2 * | 5/2003 | Moberg | 108/51.3 |
| 7,475,639 | B2 * | 1/2009 | Chen | 108/51.3 |
| 2004/0081453 | A1 * | 4/2004 | Hara et al. | 396/512 |
| 2009/0188411 | A1 * | 7/2009 | Gibson et al. | 108/51.3 |

FOREIGN PATENT DOCUMENTS

| | | |
|---|---|---|
| DE | 4038171 C1 | 2/1992 |
| EP | 1147991 A1 | 10/2001 |
| WO | WO93/10011 | 5/1993 |
| WO | WO95/29103 | 11/1995 |

* cited by examiner

*Primary Examiner*—Anthony Stashick
*Assistant Examiner*—Madison L Wright
(74) *Attorney, Agent, or Firm*—Jacobson Holman PLLC

(57) ABSTRACT

A three-dimensional frame structure or support structure for transporting and/or storing at least one object, which has a multitude of support elements, which are or can be joined to one another and extend at least along the outer edges of the frame structure or support structure while defining it. Each support element is made of a multilayered composite of tightly packed sheets or boards made of a corrugated paper or cardboard material, particularly corrugated board. A method for easily and rapidly producing a three-dimensional frame structure or support structure of the aforementioned type.

10 Claims, 4 Drawing Sheets

FIG.4
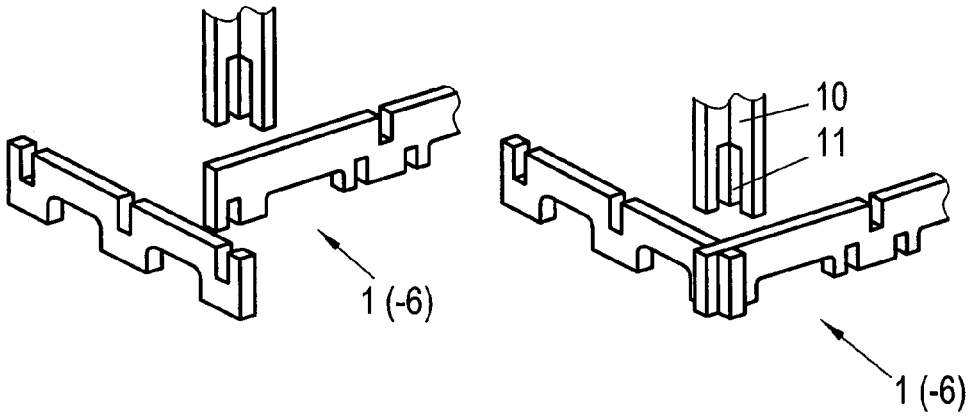
FIG. 5
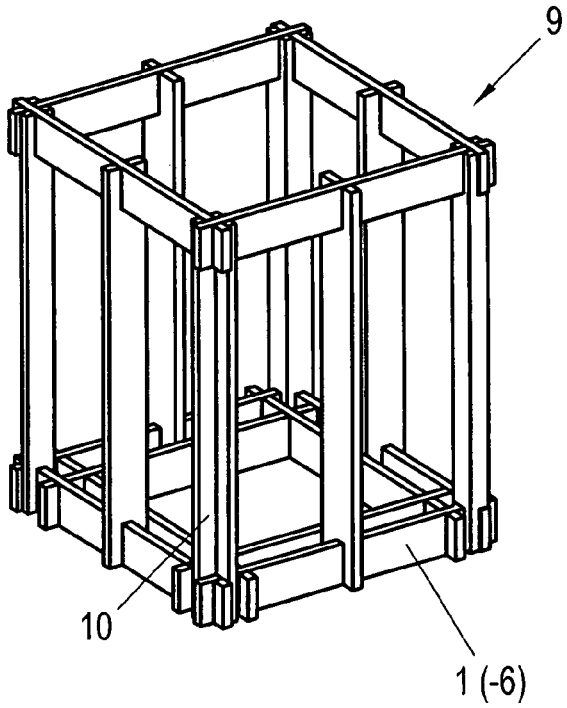
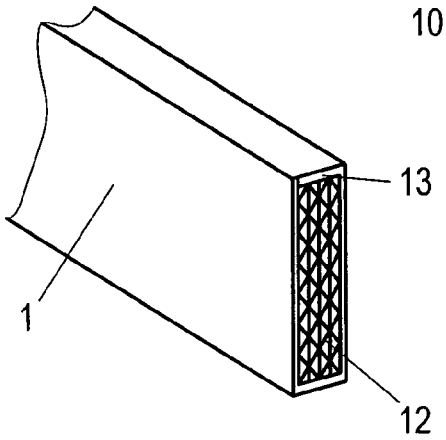
FIG. 6

THREE-DIMENSIONAL FRAME STRUCTURE OR SUPPORT STRUCTURE FOR TRANSPORTING AND/OR STORING AN OBJECT AND METHOD FOR THE PRODUCTION THEREOF

This is a continuation of PCT/AT05/000467 filed Nov. 18, 2005 and published in German.

FIELD OF THE INVENTION

The present invention relates to a three-dimensional frame structure or support structure for transporting and/or storing at least one object as well as a method for producing such a three-dimensional frame structure or support structure.

PRIOR ART

In the context of storing and transporting objects, various frame or support structures have become known, in particular for packaging an object of optionally considerable weight. Thus, case-like containers made, for instance, of wood or metal are, for instance, known, in particular, for transport purposes, such case-like containers optionally having standardized dimensions. For the reliable arrangement or support of objects of optionally considerably weight, additional bearing or supporting elements have to be provided to secure the object, in particular, against slipping. Such additional supporting or bearing elements in most cases must be adapted to the specific external shape of the object to be accommodated, which would involve accordingly high operating expenditures. Such case-like containers, moreover, involve the drawback that, if to be used again, they will be returned, for instance, to a location of dispatch while requiring an accordingly high space demand or transport volume, whereupon they will again be able to be filled with an object. Moreover, such case-like containers usually have very high dead weights such that accordingly increased costs have to be taken into account for weight-dependent transports.

In order to reduce the dead weight for the transport of used storage elements, it was, for instance, proposed in U.S. Pat. No. 5,487,335 or EP-A 0 611 354 to produce pallet elements or members of a cardboard or corrugated board material, wherein, by providing an appropriate plurality of stiffening or support elements, such a pallet produced of cardboard also had to have sufficient strength to accommodate even heavy loads.

SUMMARY OF THE INVENTION

The present invention aims to provide a three-dimensional frame structure or support structure for transporting and/or storing at least one object and a method for producing the same, wherein such a frame or support structure for the production of a package is to have a reduced weight as compared to known configurations, yet at an appropriate strength and resistance. In addition, the invention aims to enable the adaptation to different external contours of at least one object to be accommodated, while achieving a simple and cost-effective production. Furthermore, it is particularly aimed to enable a return of the frame or support structure, or the package formed thereby, for a reuse of the frame or support structure, in particular, while achieving a reduced space demand or transport volume after the removal of a transported object.

To achieve the above-mentioned objects, a three-dimensional frame structure or support structure for transporting and/or storing at least one object is essentially configured in that it comprises a plurality of interconnected or interconnectable support elements extending at least along the outer edges of the frame or support structure while defining the same, wherein each of the support elements is comprised of a multi-layer composite of tightly packed sheets or plates made of a corrugated paper or cardboard material, particularly corrugated board. Due to the fact that, according to the invention, it is proposed to produce the support elements each extending at least along the outer edges of the frame or support structure while defining the same, of a multi-layer composite of tightly packed sheets or plates made of a corrugated paper or cardboard material, particularly corrugated board, it is safeguarded that a frame or support structure having a low dead weight at a sufficient strength and resistance even for the accommodation of objects or loads optionally having considerable weights is made available. It is, thus, feasible to provide an appropriate selection of support elements in correspondence with at least one object to be accommodated or transported, in order to make available a three-dimensional frame or support structure also by utilizing an accordingly optimized or minimized space demand or transport volume. The support elements made of multi-layer composites, particularly of corrugated board, exhibit an accordingly high strength and stiffness such that even objects having large weights can be safely transported.

For a simple and rapid connection of individual, adjoining support elements, it is provided according to a further preferred embodiment that each of the support elements, at least on its end regions, comprises at least one incision or indent and/or a depression, which cooperate with at least one complementary depression or recess provided in an adjacent support element to be accordingly connected therewith. Such incisions or indents and/or depressions can be produced in the compound material forming the support elements in a simple and reliable manner so as to enable such support elements to be connected in a simple manner via their complementary depressions and indents in order to produce the three-dimensional frame or support structure according to the invention.

As already indicated above, an essential criterion of a three-dimensional frame or support structure particularly intended for reuse is that, in addition to offering a favorably low dead weight, it should also enable the return transport or transport after the removal of an object with as low a space demand or transport volume as possible. In this connection, it is proposed according to a further preferred embodiment that the support elements are at least partially detachably connectable with one another, particularly pluggable into one another. Due to the fact that according to the invention, the support elements are at least partially detachably connectable with one another, particularly pluggable into one another, it has become feasible to enable not only the simple production of a three-dimensional frame structure or support structure according to the invention by using optionally standardized support elements with a small number of different dimensions, but also the disassembly of the three-dimensional frame structure or support structure after transportation, or removal of the accommodated object, in a simple manner by detaching the support elements, which are advantageously merely plugged one into the other, and, hence, the return of the same with a strongly reduced space demand or transport volume and, also in a simple manner, its reassembly to again form an immediately usable three-dimensional frame structure or support structure.

Particularly with support elements stretching large areas and forming at least the outer edges of the three-dimensional frame or support structure according to the invention, an additional reinforcement or bracing may be required to obtain the necessary strength or capacity. In this context, it is proposed according to a further preferred embodiment that, in planes stretched by support elements each arranged along an outer edge of the frame or support structure, additional support elements are connectable with the support elements forming the outer edges, said additional support elements, in particular, extending substantially parallel with at least one of the outer edges.

In order to obtain sufficient strengths or resistances, in particular in the region of vertical support elements of the assembled frame or support structure according to the invention, it is proposed according to a further preferred embodiment that, with the assembled three-dimensional frame or support structure, support elements forming outer edges and extending substantially in the vertical direction have, in particular, L-shaped or cross-shaped cross sections normal to the longitudinal axes of the supports and, in their end regions, are formed with L-shaped or cross-shaped incisions or depressions, which overlap support elements located in a plane extending substantially normally thereto. Such support elements having L-shaped or cross-shaped contours in terms of cross section are likewise producible in a simple manner of a composite of corrugated material, particularly corrugated board, while providing an accordingly high strength. Due to the L-shaped or cross-shaped incisions or depressions preferably provided in the end regions, accordingly safe connections of adjacent support elements will also be obtained in the corner regions of the frame or support structure to be produced.

In order to obtain a closed package or closed transport container using the three-dimensional frame or support structure according to the invention, it is, moreover, proposed that paneling sheets or plates are fixable to the support elements on the outer sides of the boundary surfaces formed by the support elements, of the frame or support structure, as in correspondence with a further preferred embodiment. Such paneling sheets or plates may likewise be, preferably detachably, mounted to the support elements forming the frame or support structure and, hence, be likewise returned after use in a disassembled state requiring reduced space, for reuse.

As already indicated above, the positioning of an object to be transported in manner particularly secured against slipping or shifting is optionally required, wherein, for instance in the connection with the production of wooden boxes or containers, such additional bearing elements each had to be customized to the outer contour of an object to be packaged and transported. For a reliable mounting in this respect, it is proposed according to the invention that additional, in particular beam-shaped or carrier-shaped, bearing elements are provided in the interior of the three-dimensional frame or support structure stretched by the support elements, which additional bearing elements are adapted to the outer contours of an object to be accommodated and surround the object to be accommodated, particularly over its entire outer periphery, as in correspondence with a further preferred embodiment of the frame or support structure according to the invention. Such beam-shaped or rod-shaped bearing elements via suitable indents or depressions can again be arranged in a simple manner in complementary indents or depressions of the support elements at least defining the outer edges, so as to enable the safe positioning and accommodation of an object to be transported.

In order to achieve a similarly low weight of these optionally required, additional bearing elements, it is proposed according to a further preferred embodiment that the additional bearing elements are likewise comprised of a multilayer composite of tightly packed sheets or plates made of a corrugated paper or cardboard material, particularly corrugated board. In this manner, the additional bearing elements too can be produced in an accordingly simple manner and with little weight and are likewise, preferably detachably, for instance plugably, connected with adjacent support elements.

The use of composite elements comprising a plurality of tightly packed sheets or plates made of corrugated paper or cardboard material allows for the optimum adaptation to the outer contour of an object to be packaged while taking into account the usually comparatively small thickness of corrugated materials, wherein, in this connection, it is proposed according to a further preferred embodiment that the sheets or plates of the additional bearing elements are punched, in particular individually and with optionally increasing or stepwisely differing external dimensions corresponding with an inner contour of the object to be accommodated, and subsequently assembled to a composite. Thus, additional bearing elements can also be cheaply and quickly produced, optionally even in small quantities, to provide an optimum securement against slipping and shifting of the object to be accommodated.

For the reinforcement or stiffening of partial regions particularly subjected to pointwise stresses, of the three-dimensional frame or support structure and/or for an additional securement of an object to be accommodated, it is, moreover, proposed that additional reinforcing or stiffening or fixing or retaining elements are provided for an object to be transported, which are, in particular, made of a material having an increased strength over the support elements and, in particular, plastic, metal or the like, as in correspondence with a further preferred embodiment of the frame or support structure according to the invention.

To solve the initially mentioned objects, a method for producing a three-dimensional frame structure or support structure for transporting and/or storing at least one object, comprising a plurality of interconnected or interconnectable support elements extending at least along the outer edges of the frame or support structure while defining the same, essentially comprises the steps of:

providing the parameters, in particular external dimensions and weight and/or weight distribution, of the object to be packaged;

selecting the support elements required for the formation of a three-dimensional frame or support structure surrounding the object to be accommodated, and optionally required additional elements; and assembling the support elements to form said three-dimensional frame or support structure.

It is, thus, feasible by simple method steps to provide, and assemble in a simple manner, support elements each adapted to an object to be packaged and accommodated, for the production of the three-dimensional frame or support structure according to the invention. As already indicated above, the support elements are preferably detachably or separately plugged or arranged one within the other so as to enable the three-dimensional frame or support structure to be disassembled and again returned with little space demand and transport volume after a transport has been effected and the object to be transported and accommodated has been removed.

In order to provide an additional securement of an object to be accommodated, it is proposed according to a further preferred embodiment that additional bearing elements are produced, which are adapted to the outer contour of the object to be accommodated and received and anchored in the interior of the frame or support structure stretched by the support elements.

For a particularly simple and quick as well as cost-effective production of the bearing elements, it is proposed according to a further preferred embodiment that the additional bearing elements are produced of a plurality of sheets or plates made of a corrugated paper or cardboard material by punching.

It is, in particular, feasible, when providing additional bearing elements adapted to the outer contour of an object to be accommodated, to provide a substantially double frame or support structure, wherein the outer frame formed by the support elements is able to substantially assume a supporting and stacking function for the formation of the three-dimensional frame or support structure, while the additional bearing elements adapted to the outer contour of the object to be transported form an additional internal structure or inner frame and, hence, provide or ensure a protecting and fixing function.

In addition to the advantages in terms of weight provided by the production of the frame or support structure according to the invention, using support elements each produced of a multi-layer composite of sheets or plates made of a corrugated paper or cardboard material, particularly corrugated board, it is to be anticipated that also a clean and parasite-free packaging, or frame or support structure, will be provided. The frame or support structure according to the invention can be readily adapted to the transport item to be transported or accommodated, using a small quantity of different support elements and/or bearing elements, and disassembled and reused due to the detachable or separatable connection of the individual elements, as already pointed out above several times, and, in the non-used state, transported while occupying a small transport volume. In addition, the three-dimensional frame or support structure according to the invention, if required, can optionally be combined with other packaging systems such that, for instance, additional boxes made, for instance, of cardboard, wood or the like, and surrounding the frame or support structure according to the invention can be additionally used to provide additional protection, or additional damping elements like cushions, inflatable packages or the like can be additionally employed.

The method according to the invention, in particular, allows for the customer-specified adaptation of the three-dimensional frame or support structure to be produced and, in particular, if optionally required, additional bearing elements for an additional fixation and support of the object to be transported, wherein, for instance, after the provision of the data relating to the outer contour and the weight or weight distribution of the object to be packaged, a prototype both of the three-dimensional frame or support structure and of the optionally required additional bearing elements is made.

After an optionally required test, the additionally required bearing elements, in particular, will be produced in the form of interconnectable plates or sheets of corrugated material, particularly corrugated board, and connected subsequently, wherein it is, for instance, feasible to punch the corrugated board elements if large quantities are required. Such a punching procedure allows for the cost-effective production of a large number of additional bearing elements which, in the context of the three-dimensional frame or support structure according to the invention, are combinable in a simple and, in particular, separatable or detachable manner with appropriate support elements defining at least the outer edges of the frame or support structure to be produced.

SHORT DESCRIPTION OF THE DRAWINGS

In the following, the invention will be explained in more detail by way of exemplary embodiments schematically illustrated in the drawing. Therein:

FIG. 4 illustrates different steps in assembling, in particular plugging into one another, individual support elements for the production of a three-dimensional frame or support structure according to the invention;

FIG. 5 is a perspective view of a frame or support structure according to the invention similar to the configuration depicted in FIGS. 2 and 3;

FIG. 6 is an enlarged, perspective view of a support element for the production of a frame or support structure according to the invention, from which it is apparent that the support element is formed by a multi-layer composite of sheets or plates made of a corrugated material, particularly corrugated board;

Figure 9:
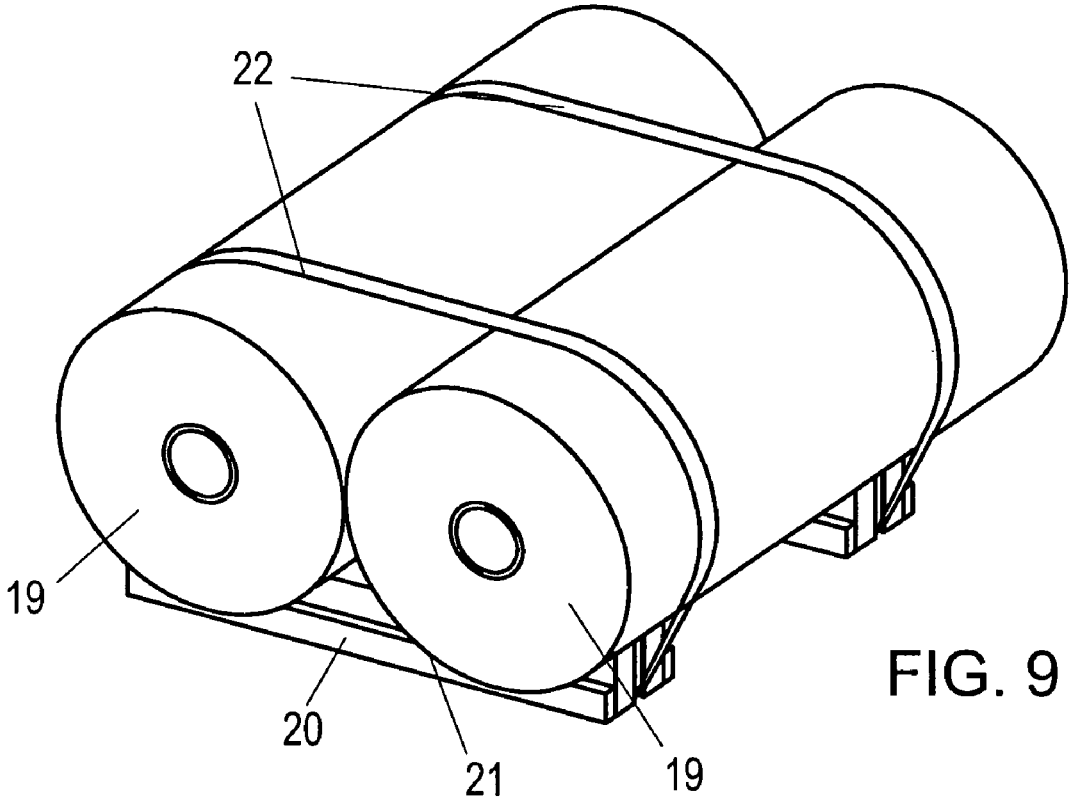
Figure 10:
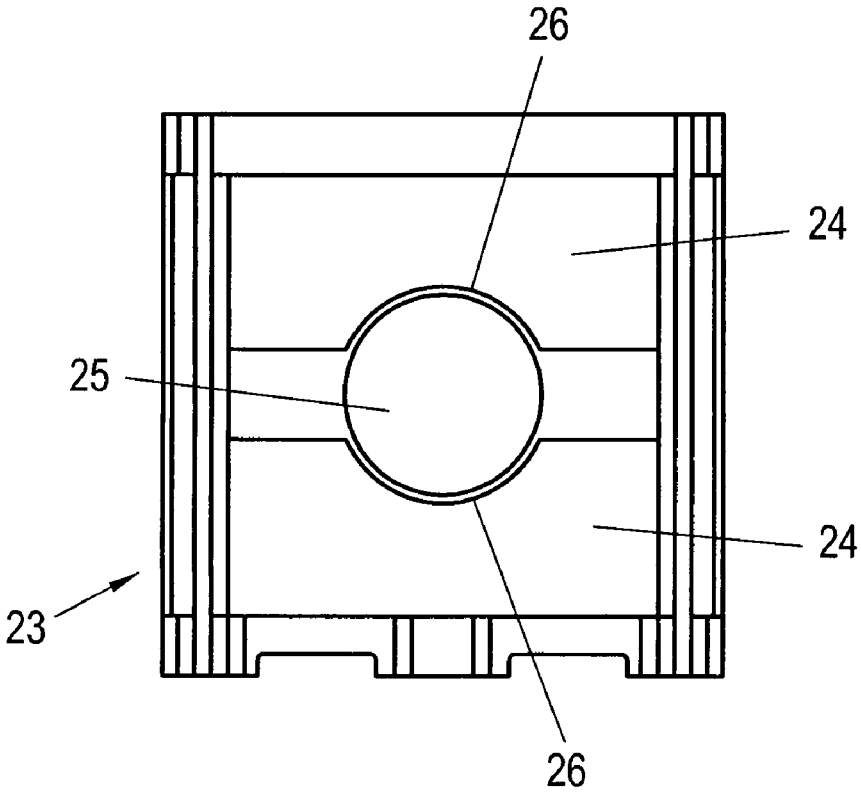

FIG. 9 is a perspective illustration of a detailed schematic view of an additional bearing element adapted to the outer contours of two roller-shaped or roll-shaped objects to be adjacently arranged, with the surrounding structure formed by the support elements having been omitted for the sake of clarity and an additional fixing element being indicated; and FIG. 10 is a schematic view of a modified embodiment of a three-dimensional frame or support structure according to the invention, wherein additional bearing elements adapted to the outer contour of an object to be accommodated are indicated in a manner similar to the illustration according to FIG. 9.

DESCRIPTION OF PREFERRED EMBODIMENTS

Figure 1:
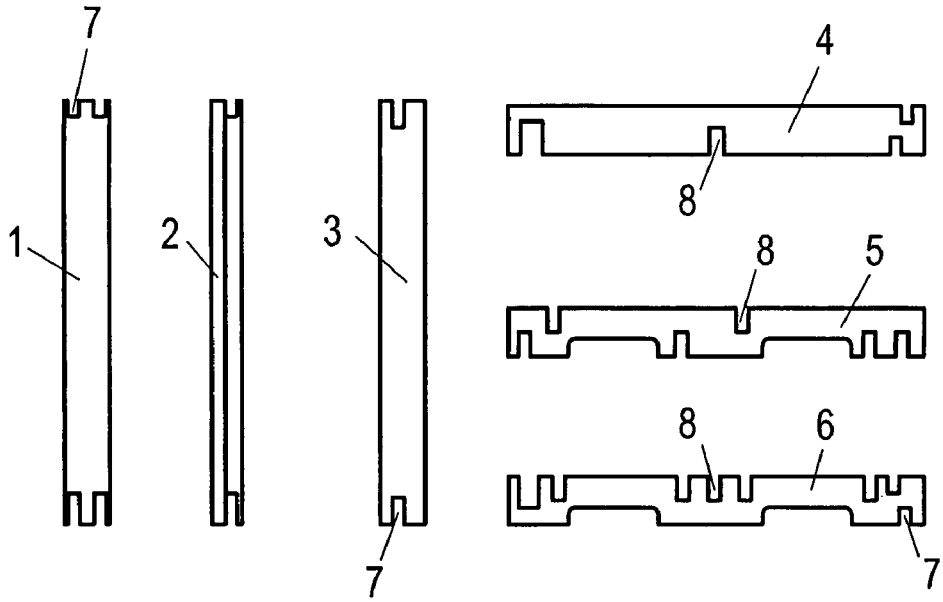
FIG. 1 depicts side views of different configurations of support elements for the production of a three-dimensional frame or support structure according to the invention.

FIG. 1 depicts a plurality of differently designed support elements, wherein each of the support elements 1 to 6 at least in its respective end regions comprises at least one depression or indent, or a recess, generally denoted by 7 to enable, in cooperation with complementary depressions or recesses of adjacently arranged or neighboring support elements 1 to 6, a, particularly separable or detachable, connection of the support elements 1 to 6 for the formation of a three-dimensional frame or support structure, as will be more clearly apparent, in particular, with reference to FIG. 4. From the illustration according to FIG. 1 it is apparent that, in particular, the support elements denoted by 4 to 6 have additional depressions or indents 8 also in their central regions, which serve to receive additional support elements as is, for instance, more clearly apparent from the illustration according to FIGS. 3 and 5.

Figure 2:
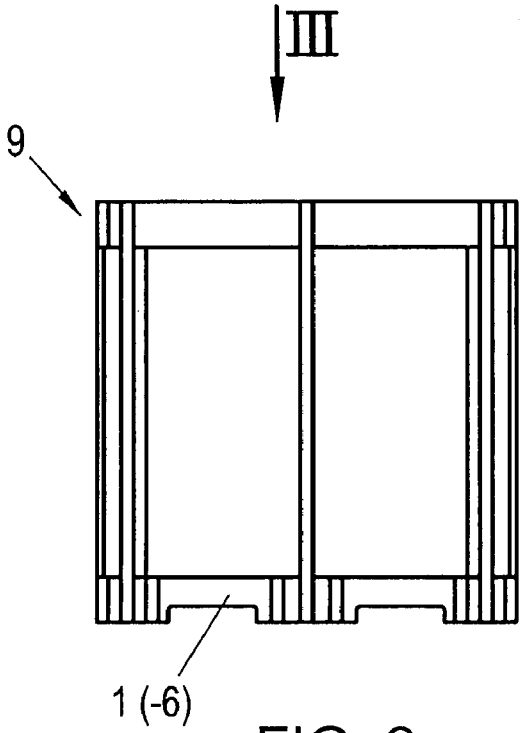
FIG. 2 is a side view of a three-dimensional frame or support structure produced, in particular, with support elements according to FIG. 1.
Figure 3:
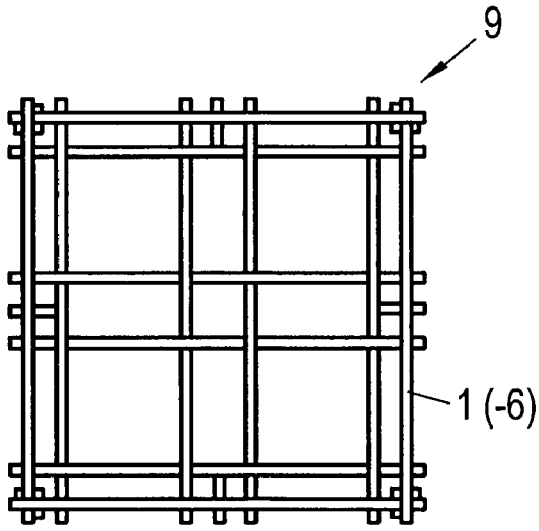
FIG. 3 is a view of a bottom element of a frame or support structure according to the invention in the sense of arrow III of FIG. 2.

FIGS. 2 and 3 depict a side view and an elevational view, respectively, of a bottom element of a three-dimensional frame or support structure generally denoted by 9, wherein it is apparent that this three-dimensional frame or support structure 9 is each comprised of a plurality of support elements, which may, for instance, be formed by the support elements 1 to 6 depicted in FIG. 1.

From the perspective illustration according to FIGS. 4 and 5, it is apparent how a plurality of support elements, which may, for instance, be again formed by elements corresponding to the elements 1 to 6 shown in FIG. 1, are assembled to form a corner connection. In this respect, it is, in particular, apparent from FIG. 4 that vertical support elements 10 have substantially cross-shaped cross sections, which have accordingly cross-shaped incisions 11 in their end regions to enable the connection of contiguous support elements 1 to 6 and 10.

From FIG. 5, an assembled three-dimensional frame or support structure 9 is likewise apparent, again in a perspective illustration. As can be taken from FIGS. 4 and 5, the three-dimensional frame or support structure 9 can be produced, and prepared for the reception of an object (not illustrated) to be transported or accommodated, by simple assembly or connection or mutual plugging. After having taken out the transported object, the three-dimensional frame or support structure can likewise be disassembled into the individual support elements in a simple manner so as to enable the support elements, or frame or support structure 9 to be produced therefrom, to be transferred to a new use with a strongly reduced space demand or transport volume. It is feasible in a likewise simple manner to replace individual, optionally damaged, elements 1 to 6 such that not all of the frame or support structure will become immediately unusable at a damage of individual support elements 1 to 6.

FIG. 6 depicts a schematic illustration on an enlarged scale, of a support element denoted by 1, wherein it is apparent that the support element 1 is comprised of a composite including plurality of tightly packed sheets or plates 12 made of a corrugated paper or cardboard material, particularly corrugated board. In this manner, the support elements are easy to produce, while obtaining the required strength and resistance properties by providing the appropriate number of sheets or plates 12 made, in particular, of corrugated board. For a simpler handling, a sheathing 13 of the support element 1 is, moreover, indicated in FIG. 6 to surround the plates.

Figure 7:
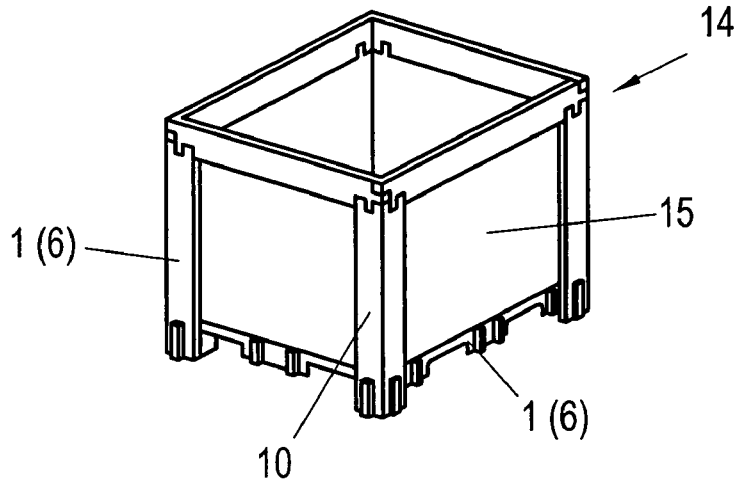
FIG. 7 is a perspective view of a modified embodiment of a three-dimensional frame or support structure according to the invention, comprising additional paneling sheets or plates for the formation of a closed container.

FIG. 7 is a perspective illustration of a modified embodiment of a three-dimensional frame or support structure 14, wherein it is apparent that additional paneling sheets or plates 15 are provided in the planes stretched by the individual support elements 1 to 6 and 10 provided on the outer edges, in order to form a substantially closed container to be used, for instance, for the accommodation of small and, in particular, lumpy objects.

Figure 8:
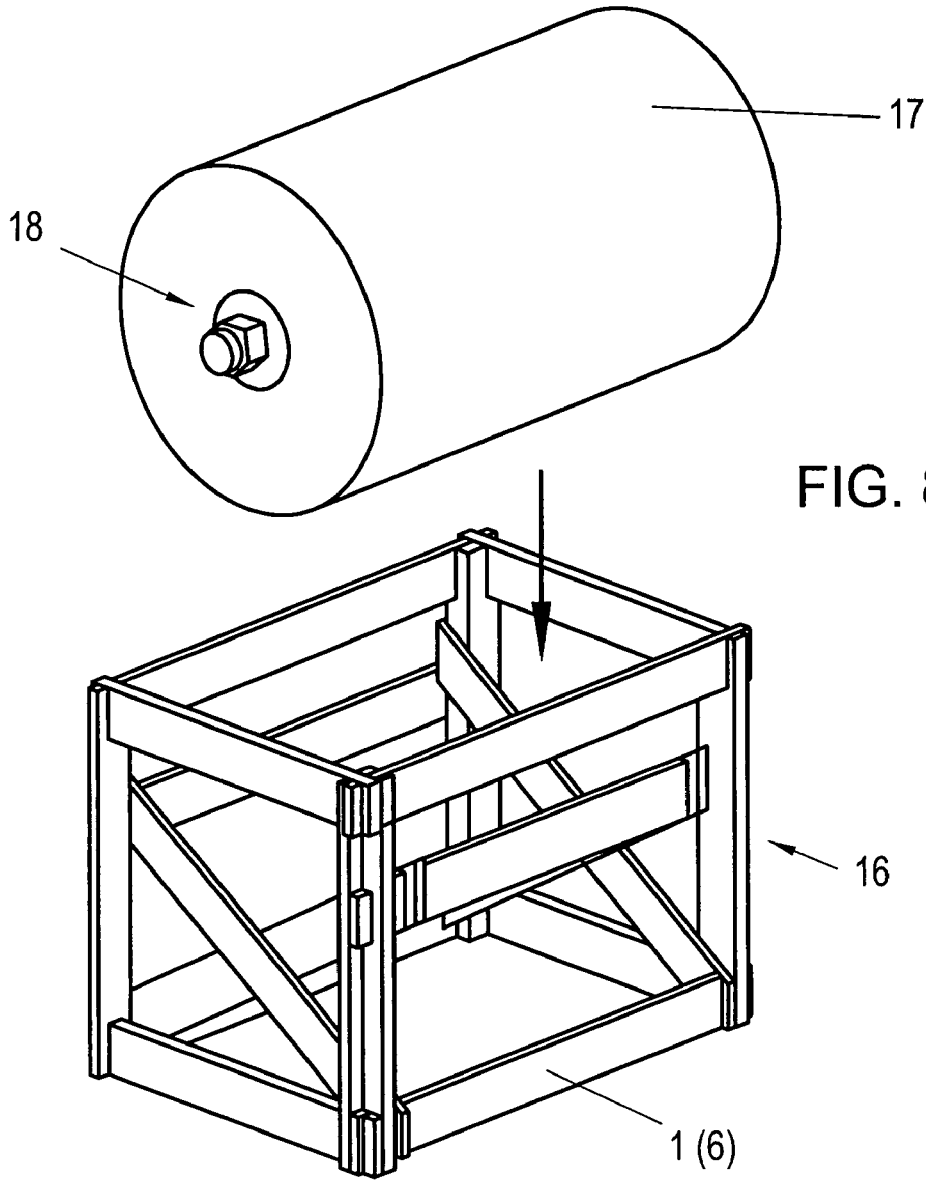
FIG. 8 is a perspective, schematic representation of the accommodation of a roller-shaped or roll-shaped object in a three-dimensional frame or support structure according to the invention.

In FIG. 8, a further modified embodiment of a three-dimensional frame or support structure 16 is illustrated, which is again comprised of a plurality of support elements formed, for instance, by elements 1 to 6. FIG. 8, moreover, indicates a roller-shaped or roll-shaped object 17 to be accommodated in the three-dimensional frame or support structure 16, wherein an additional fixing element 18 is indicated in the embodiment illustrated in FIG. 8, which is, for instance, made of a material of elevated strength, for instance a metal or plastic axle 18, to be received or mounted in the three-dimensional frame or support structure 16.

From the schematic illustration according to FIG. 9, it is apparent that two roller-shaped or roll-shaped objects 19 to be adjacently arranged or accommodated are on both ends mounted on an additional bearing element 20, said bearing element 20 having its outer shape adapted to the outer contour 21. Such additional bearing elements 20 are arranged in a three-dimensional frame or support structure illustrated, for instance, in FIG. 8 and not illustrated in detail here, such that a reliable and secured positioning of the objects 19 to be transported will be achieved. To further fasten or secure the objects to be transported, rope-like or belt-like retaining or fixing elements 22 are, moreover, indicated in FIG. 9.

In FIG. 10, a further modified embodiment of a three-dimensional frame or support structure 23 is illustrated in a schematic front view, wherein additional bearing elements 24 are indicated, which again have shapes adapted to the outer contour of an object 25 to be accommodated, i.e. bow-shaped depressions 26 in the present case. The arrangement of additional bearing elements 24 extending over large areas of the outer periphery of the object 25 to be accommodated renders feasible a secured and fixed position of the object 25 to be transported or accommodated.

Frame or support structures 23 of this type will also allow for the transportation, for instance, of objects 25 having increased weights such as, for instance, motors, gearboxes or similar objects, wherein, as a function of the weight and/or weight distribution or outer contours of the object 25 to be transported, an appropriate plurality of additional bearing elements 24 may or will be arranged in the support structure 23 so as to be distributed over the length of the object 25. These additional bearing elements 24 are, in particular, likewise detachably connectable with the support elements so as to enable the three-dimensional frame or support structure 23 to be accordingly disassembled for a reuse after transportation and transferred to such reuse with a small transport volume.

If desired, it is possible to accommodate a frame or support structure represented in the preceding Figures in an additional packaging container made, for instance, of cardboard, wood or the like, in order to enhance protection. Furthermore, optionally remaining free spaces within the three-dimensional frame or support structure may be filled with additional filling or packaging materials such as, e.g., cushions or inflatable elements.

In the main, a light-weight and easily producible three-dimensional frame or support structure to be disassembled for reuse is provided, which can be adapted to the outer contour or external dimensions of an object to be transported by providing a small amount of optionally differently designed and/or dimensioned support elements 1 to 6. It is, moreover, possible to provide additional bearing elements precisely adapted to the outer contour of an object to be accommodated or transported, which serve to additionally secure and fix the object to be accommodated and likewise are produced of a light-weight material. These bearing elements can be produced in a simple manner and at low costs in high quantities, for instance by punching sheets or plates from a corrugated paper or cardboard material and, similarly to the support elements 1 to 6, formed to additional bearing elements comprised of multi-layer composites.

The invention claimed is:

1. A three-dimensional frame structure or support structure for transporting and/or storing at least one object, comprising two spaced sets of interconnected or interconnectable support elements forming at least outer edges of the frame or support structure, each of the support elements including a multi-layer composite of tightly packed sheets or plates made of a corrugated board, the support elements being at least partially detachably plugable into one another, additional support elements being connected with the spaced sets of support elements forming the outer edges, said additional support elements extending substantially vertically in planes defined by the two spaced sets of support elements, the additional support elements having L-shaped or cross-shaped cross sections normal to longitudinal axes of the additional support elements, and end regions of the additional support elements overlapping the support elements and interlocking with the support elements located in a plane extending substantially normally thereto.

2. The three-dimensional frame structure or support structure according to claim 1, wherein each of the support elements, at least at end regions, includes at least one incision or indent and/or a depression, which cooperate with at least one complementary depression or recess provided in an adjacent support element to be accordingly connected therewith.

3. The three-dimensional frame structure or support structure according to claim 1, wherein paneling sheets or plates are fixed to the support elements on the outer sides of the boundary surfaces formed by the support elements.

4. The three-dimensional frame structure or support structure according to claim 1, wherein beam-shaped or carrier-shaped bearing elements are provided in an interior of the three-dimensional frame or support structure framed by the support elements, the bearing elements are adapted to outer contours of an object to be accommodated and surround the object to be accommodated over an entire outer periphery of the object.

5. The three-dimensional frame structure or support structure according to claim 1, wherein reinforcing or stiffening or fixing or retaining elements are provided for an object to be transported, which are made of a material having an increased strength over the support elements.

6. The three-dimensional frame structure or support structure according to claim 1, wherein the support elements are at least partially detachably plugable into one another by complementary shaped recesses.

7. The three-dimensional frame structure or support structure according to claim 6, wherein the additional support elements are connected with the spaced sets of support elements by additional complementary shaped recesses located in the support elements and in the end regions of the additional support elements.

8. The three-dimensional frame structure or support structure according to claim 1, wherein flat support elements extend between the two spaced sets of support elements, each of the flat support elements is located between two of the additional support elements.

9. The three-dimensional frame structure or support structure according to claim 8, wherein the flat support elements include a recess in each of two opposite end regions, the recess is shaped complementary to a recess in the support elements forming the two spaced sets of support elements.

10. A method for producing a three-dimensional frame structure or support structure for transporting and/or storing at least one object; including a plurality of interconnected support elements forming outer edges of the frame or support structure, said method comprising the steps of:

providing external dimensions and weight and/or weight distribution, of the object to be packaged;

selecting the support elements required for the formation of a three-dimensional frame or support structure surrounding the object to be accommodated;

assembling the support elements by interconnecting complementary recessed portions of the support elements to form two sets of horizontally extending, vertically spaced support elements; and assembling additional support elements in a vertical orientation between the two sets of support elements by interconnecting recesses in end regions of the additional support elements with complementary recesses of the support elements.

* * * * *